US007597148B2

(12) United States Patent
O'Malley et al.

(10) Patent No.: US 7,597,148 B2
(45) Date of Patent: Oct. 6, 2009

(54) FORMATION AND CONTROL OF GAS HYDRATES

(75) Inventors: Edward J. O'Malley, Houston, TX (US); Bennett M. Richard, Kingwood, TX (US); Paul M. McElfresh, Spring, TX (US); Aftab Khokhar, Houston, TX (US); Daniel L. Crosby, Sugar Lane, TX (US); Vu Thieu, Houston, TX (US); Roger W. Fincher, Conroe, TX (US); Larry A. Watkins, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 267 days.

(21) Appl. No.: 11/409,687

(22) Filed: Apr. 24, 2006

(65) Prior Publication Data

US 2006/0272805 A1 Dec. 7, 2006

Related U.S. Application Data

(63) Continuation-in-part of application No. 11/128,766, filed on May 13, 2005, now abandoned.

(51) Int. Cl.
*E21B 28/00* (2006.01)

(52) U.S. Cl. ..... 166/304; 166/249; 166/902; 175/68

(58) Field of Classification Search ..... 166/249, 166/304, 902; 175/68
See application file for complete search history.

(56) References Cited

U.S. PATENT DOCUMENTS 4,280,557 A 7/1981 Bodine (Continued)

FOREIGN PATENT DOCUMENTS

WO 99/57482 11/1999

(Continued)

OTHER PUBLICATIONS

"A New Acceleration Additive for Making 'Ice That Burns'," Oct. 23, 2006, Physorg.com, available from www.physorg.com/news80825894.html.

(Continued)

*Primary Examiner*—Jennifer H Gay
*Assistant Examiner*—Brad Harcourt
(74) *Attorney, Agent, or Firm*—Mossman, Kumar & Tyler PC

(57) ABSTRACT

Gas hydrates, particularly natural gas hydrates e.g. methane hydrates, may be formed and controlled within conduits and vessels by imparting energy to gas and water, for instance using agitation or vibration. The systems and methods allow for improved flow characteristics for fluids containing the gases, e.g. hydrocarbon fluids being transported, and for improved overall efficiencies. The gas and water within a gas flow path may be perturbed or agitated to initiate formation of relatively small hydrate particles. The hydrate particles continue to form as long as energy is imparted and water and hydrate guest molecules are available. High amplitude agitation of the gas and water will repeatedly break up agglomerated hydrate particles that form and encourage the formation of more and smaller particles. As more hydrate forms in this manner, less and less free water may be available proximate the gas and water contact.

36 Claims, 4 Drawing Sheets

U.S. PATENT DOCUMENTS

| | | | | |
|---|---|---|---|---|
| 5,536,893 | A | 7/1996 | Gudmundsson | |
| 5,595,243 | A | 1/1997 | Maki, Jr. et al. | |
| 5,727,628 | A | 3/1998 | Patzner | |
| 5,948,171 | A | 9/1999 | Grothaus | |
| 5,998,681 | A * | 12/1999 | Rojey | 585/15 |
| 6,158,239 | A | 12/2000 | Max et al. | |
| 6,405,796 | B1 | 6/2002 | Meyer et al. | |
| 6,418,960 | B1 | 7/2002 | Mintz et al. | |
| 6,467,542 | B1 | 10/2002 | Kostrov et al. | |
| 6,474,349 | B1 | 11/2002 | Laker | |
| 6,612,156 | B1 | 9/2003 | Hakimuddin | |
| 6,619,394 | B2 | 9/2003 | Soliman et al. | |
| 6,774,276 | B1 | 8/2004 | Lund et al. | |
| 6,973,972 | B2 | 12/2005 | Aronstam | |
| 7,234,524 | B2 * | 6/2007 | Shaw et al. | 166/304 |
| 7,357,835 | B2 | 4/2008 | McCausland et al. | |
| 2002/0169345 | A1 | 11/2002 | Johnson | |
| 2005/0217855 | A1 * | 10/2005 | Stave | 166/304 |

FOREIGN PATENT DOCUMENTS

WO WO 2007/095399 A2 8/2007

OTHER PUBLICATIONS

Twister BV, "Twister Factsheet 1", 2006, available from http://www.twisterbv.com/download/broch_factsheet_1_how.pdf.

P. Schinkelshoek, et al., "Supersonic Gas Conditioning for NGL Recovery," OTC-17884-PP, 2006 Offshore Technology Conference, May 1-4, 2006, pp. 1-4.

A. Lund, et al., "Conversion of Water to Hydrate Particles—Theory and Application," 14th Symposium on Thermophysical Properties, Jun. 2000, Boulder, Colorado, USA.

G. Ruecroft, "The Control of Crystallization Using Power Ultrasound: New Developments & Horizons in Sonocrystallization," 5th International Symposium, Polymorphism and Crystallization—Chemical Development Issues, Mar. 22-23, 2004, New Orleans, LA.

Accentus, "C3 Power Ultrasonic Technology for Optimum Control of Particle Size, Process Yield and Product Quality," CPHI Brussels, Dec. 7-9, 2004, Brussels, Belgium.

G. Ruecroft, et al., "Sonocrystallization: The Use of Ultrasound for Improved Industrial Crystallization," Organic process Research & Development, 2005, pp. 923-932, vol. 9, No. 6.

G. Ruecroft, "A Resounding Success," Manufacturing Chemist, Jun. 2006, pp. 41-43.

D. Hipkiss, "Perfect Particle Engineering," Informex 2007, Feb. 14, 2007, San Francisco, CA.

G. Ruecroft, "Power Ultrasound and Particle Engineering: Crystals for Drug Delivery and Formulation," Chemistry Today, May/Jun. 2007, pp. 12-14, vol. 25, No. 3.

G. Ruecroft, "Ultrasound, Crystallisation & Drug Formulation," Specialty Chemicals Magazine, Jun. 2007, pp. 60-62.

D. Turner, et al., "Hydrate Inhibition Via Cold Flow—No Chemicals or Insulation," Proceedings of the 6th International Conference on Gas Hydrates (ICGH 2008), Jul. 6-10, 2008, Vancouver, British Columbia, Canada.

* cited by examiner

FORMATION AND CONTROL OF GAS HYDRATES

CROSS-REFERENCE TO RELATED APPLICATION

This application is a continuation-in-part to U.S. patent application Ser. No. 11/128,766 filed May 13, 2005 now abandoned.

TECHNICAL FIELD

The invention relates generally to the control of or influence over hydrate formation within conduits and the like to improve or control flow characteristics, and more particularly relates, in one non-limiting embodiment, to the control or influence of hydrate formation using agitation and specifically vibrational energy.

BACKGROUND

A number of hydrocarbons, especially the lower-boiling light hydrocarbons, as found in formation fluids or natural gas are known to form hydrates in conjunction with water under a variety of conditions. This may be particularly true at lower temperatures and higher pressures.

Hydrates usually exist in agglomerated solid forms that are essentially insoluble in the fluid itself. As a result, any solids in a formation or natural gas fluid are at least a nuisance for the production, handling and transportation of these fluids. It is not uncommon for agglomerated hydrate solids (or crystals) to cause plugging and/or blockage of pipelines or transfer lines or other conduits, valves and/or safety devices, vessels, tanks, and/or other equipment, resulting in shutdown, loss of production, risk of explosion and injury or unintended release of hydrocarbons into the environment either on-land or offshore. Accordingly, natural gas hydrates are of substantial interest as well as a concern to many industries, particularly the petroleum and natural gas industries.

Gas and hydrocarbon hydrates are clathrates, and are also referred to as inclusion compounds. Clathrates are cage structures formed between a host molecule and a guest molecule. A hydrocarbon hydrate generally may be composed of crystals formed by host water molecules that surround the gas or hydrocarbon guest molecules. Without being limited to a particular understanding, the smaller or lower-boiling hydrocarbon molecules, particularly $C_1$ (methane) to $C_4$ hydrocarbons and their mixtures, are sometimes more problematic because it is believed that their hydrate or clathrate crystals are easier to form. For instance, it may be possible for ethane to form hydrates at as high as 4° C. at a pressure of about 1 MPa. If the pressure is about 3 MPa, ethane hydrates can form at as high a temperature as 14° C. Even certain non-hydrocarbons such as carbon dioxide, nitrogen, oxygen and hydrogen sulfide are known to form hydrates under the proper conditions. Several of these non-hydrocarbons, such as carbon dioxide and nitrogen, are known to exist in produced hydrocarbon fluids and therefore present an added risk of hydrate formation.

Controlling, inhibiting, and/or preventing hydrate formation, and particularly removing hydrate deposits may be a difficult, dangerous and expensive process. Presently, hydrate formation may be often controlled by using chemicals and/or active heating. Remediation of a plugged conduit often employs some combination of active heating, chemicals and/or depressurization. The use of inhibition chemicals, depressurization and/or heaters may be logistically complex and expensive and may incur a certain amount risk to field personnel.

Some arrangements are known to try to clean hydrates or other matter from wellbores using acoustic energy. The vibratory transducers used in these earlier approaches are typically operated at high vibration frequencies, in one non-limiting understanding. These high frequency vibrations are used to shatter the matrix of an already formed hydrate plug or to remove an existing deposit of hydrates or other matter. It is believed, however, that these higher frequencies are not effective in preventing the initial deposition of hydrates and other deposits within portions of a wellbore or pipeline. Thus, these prior approaches have not been effective in preventing the initial agglomeration and build-up of hydrates within the conduit.

Other systems and methods for inhibiting the deposition of natural gas hydrates are described in the parent application to this one. These techniques focused on inhibiting the formation and growth of a hydrate matrix that would allow a solid plug or blockage to develop within a flowbore. In described embodiments, an acoustic inhibitor may be associated with a wellbore proximate the wellhead and may be used to generate a low frequency acoustic energy signal that is propagated axially through the wellbore. The wellbore was used as a waveguide to propagate the energy signal. In one non-limiting embodiment, the acoustic waves are generated at a frequency in a relatively low frequency range that may be generally from about 1000 Hz to about 2200 Hz. Particularly effective frequencies for inhibiting the growth and formation of a hydrate matrix are 1130 Hz and 2000 Hz.

While existing techniques for inhibiting matrixes of hydrates and/or other deposits are useful, they are generally not sufficient to address many or most situations. Prior techniques employing sonic techniques focus their effectiveness on the inner surfaces of the pipeline or production tubing rather than on the material being transmitted through the pipeline or production tubing. As such, they do not provide any protection against hydrate deposits that might form in transportation flowbores, such as subsea pipelines.

It would be desirable if methods and apparatus were devised to make gas hydrate formation more controllable and predictable.

SUMMARY

Devices and methods are provided for improved formation of natural gas hydrates within conduits, pipelines, tanks, vessels and the like. Natural gas in this context incorporates both hydrocarbons and non-hydrocarbons, such as carbon dioxide and hydrogen sulfide, known to form hydrates and to exist in natural gas hydrocarbon systems. The term "gas hydrates" as used herein should be understood to include natural gas hydrates as well as gas hydrates formed around molecules other than those found in natural gas. It is expected that the methods and apparatus described herein will find utility and applications in technical fields beyond the recovery and/or transportation of hydrocarbons. Thus, the systems and methods described herein may allow for improved flow characteristics for the natural gas or other gas or hydrocarbons being transported and improved overall efficiencies.

In accordance with the systems and methods described herein, the gas/water interface (a hydrocarbon/water interface, in one non-limiting embodiment) within a conduit or vessel may be agitated or perturbed to initiate the formation of small hydrate particles. The hydrate particles may continue to form as long as agitation is sustained and water and any hydrate guest molecules are available. High amplitude agitation of the gas and water may repeatedly break up the hydrate particles that form and encourage the formation of more and smaller particles. The increased number of particles may provide an increased seed surface area upon which more hydrates can form, although the inventors do not wish to be limited to any particular theory or explanation. This conversion increases the efficiency of free water removal from the fluid being transported and may allow the resulting hydrate particles to more freely flow through the conduit along with the produced gas or hydrocarbon fluid without being deposited onto pipeline walls, valves, and other equipment. Thus, the hazards associated with hydrates may be significantly reduced or eliminated.

A flowbore is defined herein as a conduit through which a fluid, e.g. liquid, gas or mixture thereof may flow. It includes, but is not necessarily limited to, wellbores, annuli, pipes, pipelines, conduits, tubes, umbilicals, ducts, channels and the like.

It will be appreciated herein that controlling the agglomeration of gas hydrates by the intentional formation thereof occurs where the gas or guest molecules and water molecules mix, mingle, contact and otherwise meet and/or encounter. It should be understood that the methods, systems and apparatus herein may be employed in situations where the gas and water are already mixed, e.g. atomization in a process vessel. It is expected that the methods and apparatus described herein will be operable where there is contact between gas and water molecules, even where the gas or guest molecules are in a solid state contacting or commingled with liquid water. Systems, situations, settings or environments where gas and water meet include, but are not necessarily limited to interfaces, in a non-limiting embodiment where gas phase(s) and water phase(s) meet, as well as embodiments where gas molecules are dispersed, dissolved and/or otherwise distributed within a hydrocarbon and/or water or mixture or emulsion. However, it will also be understood that the commingling of gas and water may not at any point resolve into or exist as discrete, detectable or distinguishable "phases" as that term is generally understood. As used herein, the term "gas" encompasses liquid hydrocarbons in all of its various forms including condensate.

There may be provided in one non-limiting embodiment a method for controlling the agglomeration of gas hydrates within a vessel or flowbore that involves providing gas and water in a vessel or a flowbore, and imparting relative energy to at least a portion of the gas and water to promote formation of non-agglomerating hydrate particles.

There may be provided in an alternate, non-restrictive embodiment a system for controlling gas hydrates within a vessel or flowbore, the system including at least one vessel or flowbore containing gas and water, and at least one energizer proximate to the gas and water to agitate at least one portion of the gas and water and promote formation of non-agglomerating hydrate particles.

Figure 1:
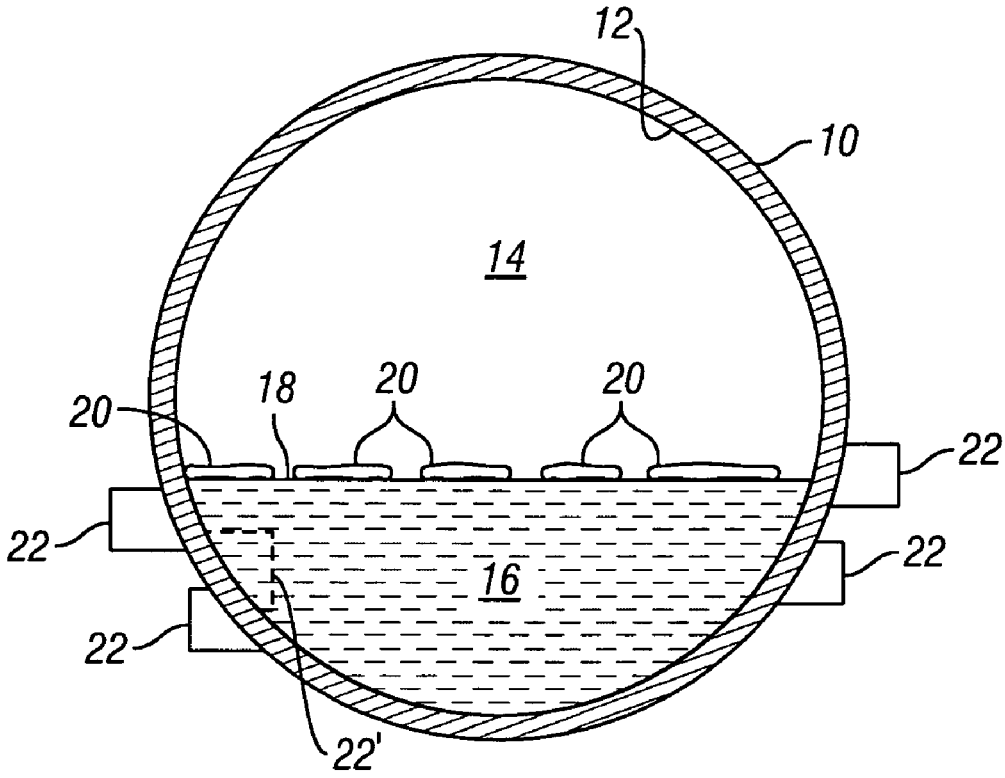
FIG. 1 is an axial cross-sectional view of a non-limiting, exemplary hydrocarbon transportation pipeline having energizers (e.g. acoustic vibrators) constructed in accordance with the apparatus and methods herein.

It may be appreciated that the Figures are schematic illustrations of various non-restrictive embodiments of the apparatus described herein and they are not necessarily drawn to scale or proportion to illustrate the salient or important features of the apparatus and/or methods discussed.

DETAILED DESCRIPTION

It has been discovered that mechanical methods, in one non-limiting embodiment acoustic vibration techniques, may control hydrate formation either independent of, or in conjunction with, other mechanical or chemical means of flow assurance control. Flow assurance control is defined here as the use of any substance, device or environment to control or improve the restriction or plugging of a conduit or flowbore. Restriction and plugging substances include, but are not limited to hydrates such as gas hydrates, scales, waxes, asphaltenes, naphthenates, and/or combinations thereof. Controlling the agglomeration of gas hydrates includes, but is not necessarily limited to controlling plugging caused by gas hydrates.

In the embodiment where the imparting of energy to gas and water to promote hydrate formation is accomplished without the co-use of gas hydrate controlling or promoting chemicals, the methods and systems herein may be relatively more environmentally compatible and advantageous.

It has been discovered that vibrating, perturbing, stimulating, disturbing or otherwise agitating the gas/water interface or other environment of gas and water may permit, facilitate, encourage or enable gas hydrates to be intentionally but controllably formed. In one non-limiting embodiment, it is supposed that by ensuring or facilitating or improving contact between the gas molecules and the water molecules, a particular ratio (which may be stoichiometric or non-stoichiometric) of water-molecules forming a host "cage" around a gas molecule "guest" may be achieved, with little or no free water molecules (water molecules not bound up into the host "cage" structures) to serve as the "glue" to agglomerate or bind the gas hydrate particles together into problematic agglomerations. That is, the absence of significant amounts of free water inhibits the undesired formation of large plugs or blocks of hydrates within the flowbore or vessel. However, it may be appreciated that the inventors do not want to be limited to any one explanation of how the methods and apparatus herein might work or embodiment thereof.

It may also be appreciated that the particular ratio of water necessary to form a gas hydrate host "cage" for a particular gas "guest" molecule may depend on the particular guest molecule; for instance, larger "guest" molecules would be expected to require more water molecules to form a hydrogen-bonded "cage" around the gas molecule. It is more common for hydrates to form in non-stoichiometric ratios since not all cages or cavities need to be filled by gas molecules for the whole or entire hydrate structure to be stable.

It will be further appreciated that the term gas hydrate "particles" herein includes, but is not necessarily limited to, the clathrates and cages described above, heterogeneous crystals (i.e. including both gas molecules and water), molecular structures chemically defined in the literature as hydrates and/or clathrates, seed crystals (whether or not such seed crystals grow or are the starting point for a larger hydrate formation). By "non-agglomerating" hydrate particles is meant that the hydrate particles do not stick, bond, join, adhere, fuse, accumulate, cohere, or otherwise agglomerate into problematic masses, that is they have enhanced stability against agglomerating, are freely dispersed or in a state of free dispersion or free to move independently with respect to one another with an absence of significant tendency to adhere or stick together or accumulate. In another non-restrictive sense, it may be understood that the non-agglomerating gas hydrate particles whose formation is being promoted has a "controlled stickiness". That is, it is not necessary that the gas hydrate particles be completely devoid of any tendency to agglomerate, but that they do not agglomerate to an extent that creates problems. Particles of such "controlled stickiness" are within the term "non-agglomerating" herein. This does not however, mean that the hydrate particles will never subsequently encounter an environment that would cause them to agglomerate, for instance if they experience a change in pressure.

In one non-restrictive understanding of the methods herein, it may be useful to form as many particles as possible of a particular size, or within a particular size range or of an average particle size. The desired gas hydrate particles are considered "controllable" in that they are within a certain size range and do not increase or grow to a problematic size while they are handled, and then are allowed to decompose into their constituent gas and water components at a location and time where the parts can be properly processed. The gas hydrate particles promoted are generally small, round and compact, and do not require continued agitation or energy introduction after they are formed to maintain their ability not to agglomerate or stick together.

In another non-limiting embodiment the gas hydrate particles intentionally or controllably formed are considered "metastable". In the context of the methods and systems herein, metastable is defined as not agglomerating or sticking together at a rate or size that causes difficulty in flow or operation of the conventional equipment through which they are flowing, but at some desired and controlled point may dissociate into their respective gas and water components. Characteristic of the methods and systems described and discussed herein may include one or more of the following, but are not necessarily limited to, consumption of free water, high conversion ratio of the available free water, binding up all or nearly all of the free water, binding up all or nearly of the gas, stability over the desired production or transportation of the hydrate particles, metastable v. stable indefinitely under nearly all conditions. It can be appreciated that in a flow assurance environment, such as at a pipeline or a subsea production platform, it is necessary to maintain the control of the gas hydrate size through the flowbore, and that coalescence, sticking or agglomerating of the particles is controlled, limited or even prevented.

It will also be appreciated that in the context herein, by "non-agglomerating" it is meant not only that the gas hydrate particles do not undesirably stick to each other, but that the particles also do not appreciably stick to other solid surfaces in which they come into contact. For assurance of flow through a flowbore or into and from a vessel, the particles may be prevented or limited from agglomerating together and from accumulating on other solid surfaces to a problematic extent even though it is understood that the physical and chemical mechanisms involved may be different; that is the forces involved in gas hydrate particles tending to adhere to or be associated with one another are likely to be different between those involved in whether a gas hydrate particle will adhere to or be associated with a metal surface.

However, it will also be appreciated that in many embodiments, the methods and systems herein not only will promote the formation of non-agglomerating gas hydrates, but will often sequentially, simultaneously, or alternatively reduce the size of larger gas hydrate masses to smaller, manageable or controllable gas hydrate particles within the goals and purposes herein.

Indeed, in another non-limiting embodiment, it may be that the gas hydrate particles being promoted are forming, dissociating and reforming at a rate that keeps the particles at a size or state where the agglomerating or size or properties are being controlled to provide flow assurance and avoid problems. In this understanding which would be a kind of equilibrium or steady-state formation/dissociation of gas hydrate particles, energy would likely need to be imparted to the gas and water on a continuous basis, or at least cycling on and off sufficiently to maintain the steady state or equilibrium. It may be that different conditions obtain in those methods herein where the gas hydrates are formed once and do not need to have energy applied again to maintain their non-agglomerating condition during transport, production, etc. Again, the inventors do not wish to be limited to any particular explanation or mechanism or theory with respect to the methods and systems found effective herein.

In one non-restrictive sense, the gas hydrate particles are formed intentionally in a controllable way before they would naturally form and/or before they are formed at or in potential problem points/areas. Seen another way, the hydrate formation region is changed. Gas hydrate formation occurs stochastically, and thus it is surprising that the methods and systems described herein work on a reproducible basis. Because gas hydrate formation is stochastic—they may not form until later or further down a flowbore even though hydrate forming conditions exist; i.e. several hundred feet to a mile along a subsea pipeline, or a few multiples along length of a flowbore—it is difficult to describe the mechanisms of their formation according to the methods herein with precision.

In particular, it may be appreciated that there a large variety of ways to agitate, stimulate, invigorate, activate, disturb, perturb, excite or otherwise impart relatively more energy to locations where gas and water meet, which includes gas/water interfaces. Such mechanisms and devices include, but are not necessarily limited to, acoustic vibrators, horns, piezoelectric transducers, fluid oscillators, voice coil actuators, rotating eccentric masses, rotating or spinning stirrers, paddles, propellers, screws, combinations thereof and the like. In general herein these devices will be termed "energizers"; the energizers contribute, direct, deliver, transmit, convert, transform and otherwise impart relatively increased energy to where the gas and water meet to induce, encourage, make, generate, create, produce, engender, accelerate, foster, cultivate, and/or otherwise promote the formation of hydrate particles. It will also be appreciated that these energizing devices or structures do not necessarily have moving parts, but may inject energy to the gas and water by gravity or by the flow of the gas and water by being passive, e.g. through a static mixer. It is expected that it is possible to design a physical screen, web, field, or the like that imparts sufficient agitation or perturbation to the gas and water as they flow over or contact the structure to form non-agglomerating hydrates. The energy already present in the gas and water may be directed by a static mixer in a way that increases and imparts energy to the gas and water to promote non-agglomerating hydrate particles. In non-limiting embodiments where the energy is imparted by gravity, the structure may be similar to a gravity fall, such as weirs or bubble trays or the like. In some cases, it is expected to be possible to use flow eddies and flow dynamics to create a resonance web, e.g. vibrations or patterns at a resonance frequency using no external source of energy to create standing wave. Such a device may have strands or surfaces that would be mute or quiet during static conditions, but at a particular flow rate or other stimulus, e.g. when "plucked" or activated with gas and/or water at the right frequency; would quiver or vibrate sufficiently to impart the necessary energy for promoting non-agglomerating gas hydrates.

Even in embodiments where the energy to the gas and water is specifically or separately introduced, it will be appreciated that for most systems appreciable amounts of power need not be used. That is, sufficient energy may be supplied at levels much lower than 1 kW.

It will also be appreciated that the energy imparted to the gas and water may come from an energy source that is parasitic to another part of the system. By "parasitic" is meant that it does not come from outside the system but rather is taken from another part of the system and put to use in the methods or systems to accomplish the purpose herein of promoting the formation of non-agglomerating gas hydrates. A simple, non-limiting example would be to use at least a portion of liquid flow into a reservoir to generate energy, in one non-restrictive version, driving a vibrating energizer, in a flowbore of gas and water flowing out of the reservoir to promote the formation of non-agglomerating gas hydrates therein.

It should also be understood that the energizers used to impart energy to the gas and water need not be in direct contact with the vessel or flowbore to be effective, although they certainly may be. The energizers in many non-limiting embodiments need only be located proximate to the gas and water within sufficient range to be operably functional to accomplish the purpose of promoting the formation of non-agglomerating hydrate particles. For instance, in a non-restrictive version, an acoustic vibrator may be attached to a flowbore, but may also be distant therefrom but nevertheless in fluid contact therewith, such as in liquid or gas contact sufficient that the acoustic vibrator may vibrate or agitate the gas and water within the flowbore. Other techniques for imparting energy to gas and water may include, but are not necessarily limited to, electromagnetic radiation, e.g. microwave, infrared, magnetic fields, visible light (photonics) etc.

In another non-limiting embodiment of the method herein, more than one energy source may be used to direct or impart energy to join with other similarly remotely generated energy to a zone or area to promote the formation of non-agglomerating gas hydrates by the confluence of the one or more energy sources, such as through interference patterns or waves that would accomplish the purpose of the methods herein. That is, two or more acoustic sources, or two or more electromagnetic (e.g. visible light, microwave, etc.) sources would individually be insufficient to impart the necessary energy to the gas and water to promote non-agglomerating gas hydrate formation, but at the point, area, region or zone where the energy from the sources comes together, joins or interacts or creates or generates sufficient vibration, standing waves, fields, work or other energy to accomplish the promotion of such desirable gas hydrate particles.

In another non-restrictive embodiment herein, the energizers (e.g. vibrators) may be connected to a series or network of sensors, where the sensors may be placed at locations where uncontrollable gas hydrate formation has been a problem in the past or where formation of undesirably large masses of gas hydrates may be a problem. The sensors would detect conditions favorable to the onset of uncontrolled hydrate formation and then cause appropriately positioned energizers to impart energy to the gas and water at the location to promote the formation of non-agglomerating gas hydrate particles. The use of such sensors and appropriate energizer control and feedback network would be particularly useful in situations where the problematic formation of gas hydrate masses or undesirably large gas hydrate particles was a periodic or cyclic phenomenon that did not require continuous imparting of energy to the gas and water.

In situations involving vessels where the gas and water are essentially stagnant, quiescent, or have relatively long residence times, such as slow flow; gas treatment or low or slow circulation or counterflows, it may be more necessary to provide continuous or frequent injection or imparting of energy to the gas and water to create or promote non-agglomerating hydrate particles.

There are many potential and possible methods and devices that may be used to deliver or provide the imparted energy to the gas and water. For flowbores already in place, coiled tubing could be provided to the bottom of pipeline, e.g. left along length of pipeline where the coiled tubing contains mechanisms to impart the necessary energy to the gas and water in the interior of the pipeline. A method of delivery involving a "hot tap" to insert the necessary energy or a device to impart the necessary energy to a flowbore or vessel may be employed. It may be necessary to provide one or more hot taps with sufficient coverage, reach or radiance to affect sufficient or suitable amounts of gas and water to be effective.

Alternatively, a flowbore, riser or vessel could be outfitted with an ultrasonic grid that imparts the necessary energy to the gas and water. In another non-restrictive version, piezoelectric elements may be deployed over one or more surfaces of a vessel or a region of a flowbore to completely surround the interfaces or regions of gas and water. Piezoelectrically vibrated screens or other elements may be used.

In another non-limiting embodiment, a flowbore may be of sufficient diameter and/or design to use a pig to install energizers for imparting sufficient energy to the gas and water that will subsequently flow through the wellbore. In one non-restrictive instance, a flow bore may already have or be designed to have "parking spots", swollen places, nipples or other locations therein where a pig could leave an energizer or other tool that would impart the necessary energy in a subsequent operation. In some non-limiting versions, the pig itself may be the device or tool to impart the necessary energy on a temporary or semi-permanent basis, for instance a resonant pig that generates own electricity for agitation, perturbation or other excitation of the gas and water. On the other hand, permanently placed energizers may turn out to be the better solution in well-bores and risers.

Figure 1A:
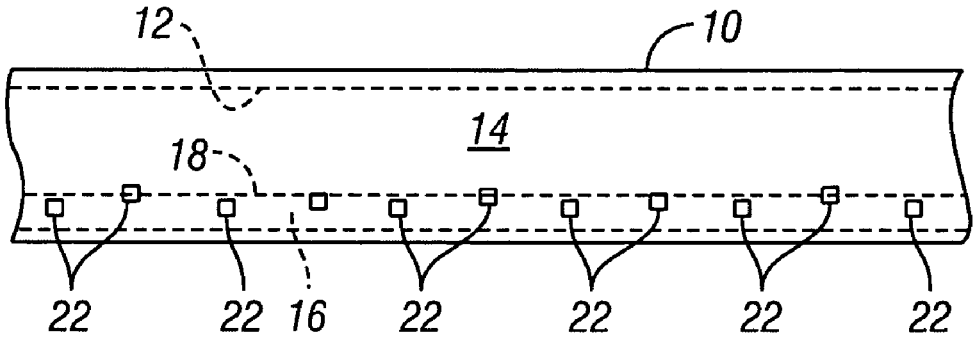
FIG. 1A is side view of a section of the pipeline shown in FIG. 1.
Figure 2:
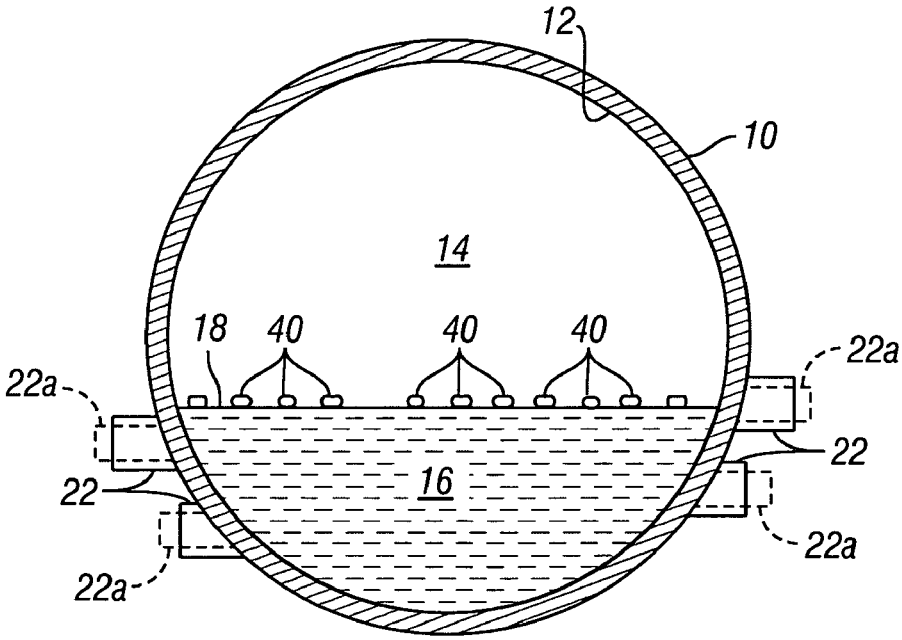
FIG. 2 is an axial cross-section of the pipeline shown in FIGS. 1 and 1A, with the vibrators active.

FIGS. 1, 1A and 2 illustrate a non-limiting exemplary natural gas pipeline 10 having a flowbore 12 that contains natural gas 14 in its gaseous state and free water 16. The pipeline 10 may be substantially horizontally oriented (or may be vertically oriented; see FIG. 7). A gas/water interface 18 exists where the gas 14 and the water 16 meet. Through the description and discussion herein of the methods and apparatus herein, the gas/water interface 18 may be schematically illustrated as a roughly horizontal line. However, it may be appreciated that on a microscopic level, the interface 18 may not be so neatly depicted and is in reality probably convoluted and complex. Solid gas/water hydrates 20 form at the interface 18. The hydrates 20 when permitted to form uncontrollably may be relatively large blocks or chunks of solids that can adhere to and build up upon surfaces and equipment within the pipeline 10 and may present a hazard to valves and other devices that they encounter during transport through the pipeline 10.

The pipeline 10 includes a number of energizers, which may in one non-limiting embodiment be acoustic vibrators 22 that are associated with the pipeline 10 so as to cause agitation or perturbation of at least a portion of the gas/water interface 18. As shown in FIGS. 1, 1A and 2, the energizers 22 are positioned on the exterior of the pipeline 10. However, they may alternatively be located within the flowbore 12 of the pipeline 10, as indicated in phantom lines 22' in FIG. 1. In one non-limiting embodiment the energizers 22 may be placed at or near the water/gas interface 18 in order to create perturbations of the interface 18 during operation. As FIG. 1A illustrates, the energizers 22 are in one version positioned in an axially spaced configuration along the length of the pipeline 10. The energizers 22 may be located at varied heights or locations upon or within or adjacent the pipeline 10 which approximate the level of the gas/water interface 18 within. It may also be appreciated that the source of agitation, e.g. acoustic vibrators 22 in one non-limiting embodiment herein, need not necessarily be positioned on the pipeline 10, but may be located within or without but in sufficient proximity to impart agitation or vibration or other perturbance or energy to the gas/water interface 18 nonetheless. For instance, the vibration or agitation could be transmitted through a gap filled with a fluid, e.g. water, oil, air, and mixtures thereof, so long as the goals of intentionally forming gas hydrate particles that to not agglomerate together are achieved.

Figure 3:
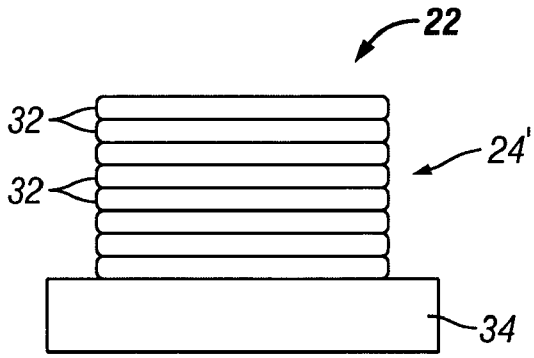
FIG. 3 schematically depicts an exemplary acoustic vibrator and associated components for use with the pipelines shown in FIGS. 1 and 2.
Figure 4:
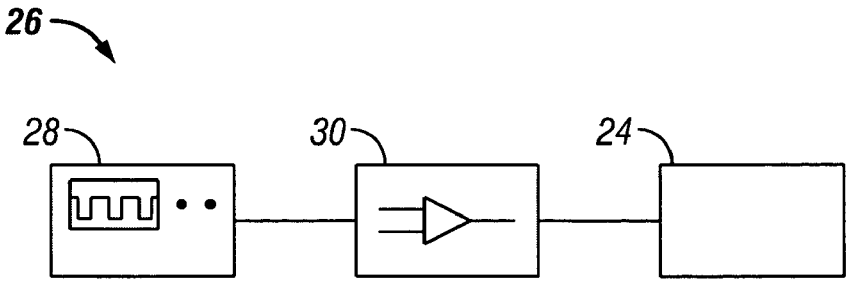
FIG. 4 is a schematic illustration of an exemplary control system for the vibrator shown in FIG. 3.

As FIG. 3 depicts, the energizers or acoustic vibrators 22 in one non-restrictive version may include a transducive vibratory element 24' (e.g. a magnetostrictive transducer in one non-restrictive embodiment) that may be formed of electroceramic material. Applying a voltage across the element 24' causes it to expand proportionally to an expanded state (see position 22*a* in FIG. 2). When voltage is removed, the element 24' returns to unexpanded state. If a voltage signal is applied at a given frequency expansion and contraction occurs in concert with the provided frequency. As FIG. 4 illustrates, in one embodiment, the vibratory element 24 may be actuated by an actuator 26 that includes a signal generator 28 to generate a sine wave electrical signal that may be provided to an amplifier 30 and then to the vibratory element 24 so that the vibratory element 24 is pulsed in accordance with a particular voltage and frequency. The amplifier 30 may be used to boost or increase the signal provided to the vibratory element 24.

The vibratory element 24 may be constructed in a number of ways. FIGS. 1 and 2 depict a first embodiment wherein the element 24 may be a monolithic rod-shaped member that may be formed of magnetostrictive material of a known type. In this embodiment, a magnetic coil (not shown) used to selectively actuate the element 24 between expanded and unexpanded conditions in response to the electrical signal provided from the amplifier 30. In addition, the element 24 might be formed of piezoelectric material, of a known type, that may deform as a function of applied voltage from the amplifier 30. In other embodiments, the vibratory element 24 may comprise a voice coil actuator, of a type known in the art, or a fluid oscillator, of a type known in the art. In a further embodiment, the vibratory element 24 comprises a rotating eccentric mass, also of a type known in the art for causing oscillations or vibration.

FIG. 3 depicts one currently suitable construction for a vibratory element 24'. A number of circular electro-ceramic, magnetostrictive or piezoelectric members, i.e., disks, 32 are glued or otherwise secured together in a stacked configuration with the electrical signal from the amplifier 30 applied to expand each of the individual members 32. The use of a stack of individual members 32 to form the element 24' may be advantageous because the stacked device may require a lower voltage to achieve a maximum expansion of the members 32. The stack of circular members 32 may be preferably secured to a base 34. The base 34 may be incorporated into or attached to the pipeline 10. The signal generator 28 and amplifier 30 meanwhile are preferably located at a central control location (not shown) so that they may be controlled and monitored by pipeline or rig personnel. Although FIG. 4 shows the signal generator 28 and amplifier 30 to be interconnected with only a single vibratory element 24, it may be understood by those of skill in the art that, in fact, the signal generator 28 and amplifier 30 are interconnected with all of the vibratory elements 24.

In one non-limiting operation, vibration of the energizers 22 generates cyclical acoustic waves that vibrate the pipeline 10 and perturb the gas/water interface 18. The flowbore 12 acts as a waveguide to help axially propagate the sonic energy. The energizers 22 are operated to pulse at a frequency that may initiate and further encourage formation of small hydrate particles 40 (see FIG. 2) at the interface 18. It may be appreciated that the Figures are not to scale and that as will be discussed below, the small hydrate particles 40 are considerably smaller than the relatively large solid gas/water hydrate masses 22 that would be sufficiently large to be problematic during transport and other operations. Additionally, it may be expected that in some non-restrictive embodiments, the agitation or vibration will break down the larger chunks 20 of hydrates into relatively smaller particles 40 so that they may be flowed along with the gas 14 and water 16 within the flowbore 12.

In one non-restrictive embodiment, the vibrations of vibrators 22 are synchronized with each other so that a coherent acoustic vibration occurs in flowbore 12. In another, alternate, non-limiting version, the vibrations of vibrators 22 are not synchronized with each other, or are asynchronous. Not having the vibrators 22 synchronized may in many instances increase the agitation or perturbation of gas/water interface 18.

In one non-limiting embodiment, the agitations and perturbations may create smaller hydrate particles 40 that are of an average particle size of less than ¼ inch in diameter (about 6.4 mm or 6400 microns) in diameter or smaller, alternatively an average particle size of 0.175 inch or smaller (4400 microns or "BB" sized). (It will be appreciated that a more standard term for "microns" is "micrometers", and herein they will be understood to be equivalent terms.) In many cases, once hydrate particles are an average particle size of larger than about 6400 microns (0.25 inch), they tend to agglomerate and/or cause flow assurance problems. Of course, whether or not a particle or body is problematic is a function primarily of the smallest orifice or opening the particle or body must pass through. For a flowbore, if the particle or body is a significant percentage of the flowbore diameter, problems occur. For large pipelines, it is conceivable that particles of "sleet" or "marble" size could be tolerated. In another non-limiting embodiment, the hydrate particles are an average particle size of about 3 mm (3000 microns) or less, alternatively an average particle size of about 2 mm or less (2000 microns). In another non-restrictive alternative, the hydrate particles 40 may be on the order of 200 microns or less in diameter, or the approximate size of powder particles. In an alternate embodiment of the invention, the hydrate particles are an average particle size of 100 micron or less; and in another non-restrictive embodiment are an average particle size of 50 microns or less; or even an average particle size of 40 microns or less. In some instances, the flow of gas hydrate particles formed by the methods and systems herein will resemble or even be indistinguishable from slurry flow.

It will also be appreciated that in some embodiments of the methods and systems herein, energy imparted to the gas and water will contact hydrate particles of larger than the desired size and reduce them to within the ranges noted above. In one non-limiting embodiment, gas hydrate particles of a size 6400 microns (0.25 inch) and larger are decreased or reduced to a size 0.175 inch (4400 microns) or smaller, or below one of the other smaller thresholds. Alternatively, gas hydrates of about 0.175 inch (4400 microns) or larger may be decreased or reduced in size to about 3 mm (3000 microns) or less, or at or below one of the other thresholds mentioned above.

Hydrate particles 40 may continue to form as long as perturbation is sustained and water 16 and gas 14 may be available. High amplitude perturbation of the gas/water interface 18 will repeatedly break up the hydrate particles 40 that form and encourage the formation of more and smaller particles 40. The increased number of particles 40 provides an increased seed surface area upon which more hydrates can form, in one non-restrictive explanation. As more hydrate forms in this manner, less and less free water 16 may be available proximate the gas/water interface 18. The absence of significant amounts of free water 16 at or near the interface 18 may then further prevent the undesired formation of large plugs or blocks 20 of hydrates within the flowbore 12. A goal of the methods and systems herein may be to form a large number of smaller hydrate particles 40 that can be easily transported through the pipeline 10 and its associated valves and equipment. The inventors have determined that the formation of gas hydrates may be a very efficient method of removing free water. In the non-limiting case of methane clathrates, the average methane clathrate hydrate composition may be one mole of methane for every 5.75 moles of water. Because free water may be the 'glue' that holds multiple hydrate particles together, binding up the free water into small hydrate particles 40 may prevent the development of larger monolithic chunks of hydrates, which are undesirable. It may not be possible to bind up 100% or all of the free water into the hydrate powder or particles 40, and it is not expected that this is necessary for the methods and apparatus herein to be successful as long as flow is maintained or possible to achieve. That is, it may not be necessary that flow of all of the hydrate particles 40 occurs to practice the method herein, although it is expected that in most cases transport will happen to achieve other goals and purposes, e.g. flowing a hydrocarbon stream with little or no problems occurring from relatively large agglomerations or masses of gas hydrates. In some cases, under certain temperature and pressure conditions, it may not be possible to form hydrate particles controllably if 80% of the composition being treated is water.

In one non-limiting embodiment, the energizers or acoustic vibrators 22 are preferably operated in a relatively low frequency range that may be generally from about 1 kHz to about 20 kHz. However, it is also contemplated that the vibrators 22 can be effective to some degree at vibration rates less than 1 kHz. It will be appreciated that these frequencies or other effective frequencies may be generated by methods other than acoustic, including, but not necessarily limited to, stirring, rotary agitation, microwave energy, photonic energy, electromagnetic energy in general, etc. It is further understood that in some non-restrictive embodiments that the acoustic vibrators 22 be operated to provide an acoustic energy having an amplitude in the range of from about 1 nm to about 1 cm. Vibrational amplitude in this method may be understood to be a measure of the power level applied. Power level may be a design parameter of the size of the system having energy imparted thereto, where generally the larger the system, the more power is required to impart sufficient energy to generate appropriate volumes of gas hydrates in a sufficiently controlled matter.

To provide a high degree of effectiveness, it is suggested that the signal generator 28 be operated to vibrate the energizers or vibrators 24 in a substantially continuous manner during flow transportation operations.

It is noted that use of the acoustic vibrators 24 and the like will not preclude the additional use of chemical inhibitors or other mechanical means in the flowbore 12. Other mechanical means or mechanisms include, but are not necessarily limited to, dehydration (water removal), operating at a higher temperature, operating at a lower pressure or insulating the vessel, pipeline and/or conduit, and combinations of these. There traditionally have been two broad techniques to overcome or control gas hydrate problems, namely thermodynamic inhibitors and low-dosage hydrate inhibitors (LDHIs). Thermodynamic inhibitors include, but are not necessarily limited to, chemicals such as methanol, glycols, and salts. These work by shifting the thermodynamic equilibrium of the system to lower temperature and higher pressure. Hydrates are completely prevented from forming provided enough chemicals are added. LDHIs are further divided into kinetic hydrate inhibitors (KHIs) and anti-agglomerants (AAs). KHIs work by affecting (delaying/retarding) the kinetics of hydrate nucleation and growth processes. Some KHIs contain lactam ring polymers, discussed elsewhere. AAs work by allowing hydrate particles to form, but keeping them small, dispersed in the liquid hydrocarbon phase, and non-agglomerating. Some AAs contain quaternary ammonium compounds discussed elsewhere.

Alternatively, methods of adding hydrocarbon or gas (together with or alternative to removing water) to thereby adjust the stoichiometric ratio of gas molecules to water molecules is also known, together or separately with being sure the gas or hydrocarbons are at a temperature and/or pressure to facilitate the production of gas hydrates in a predictable and/or controllable size to maintain and/or facilitate flow assurance. In another non-limiting embodiment, a side stream of gas or gas and water that has been removed from an upstream part of the system and optionally processed, separated or changed in some way may be reintroduced into the "mixture" stream; e.g. added through a gas lift valve or other device or mechanism. In one non-restrictive version, the method may involve some initial processing to concentrate the gas in a particular stream prior to using that stream to contact the gas and water to initiate or continue controlled hydrate formation; in one non-limiting instance of taking wet material (e.g. relatively large amount of free water) around a choke or other apparatus where gas hydrates have a tendency to form.

The kinetic approach generally attempts (a) to prevent the smaller hydrocarbon hydrate crystals from agglomerating into larger ones (known in the industry as an anti-agglomerate and abbreviated AA) and/or; (b) to inhibit and/or retard initial hydrocarbon hydrate crystal nucleation; and/or crystal growth (known in the industry as a kinetic hydrate inhibitor and abbreviated KHI). Thermodynamic and kinetic hydrate control methods may be used in conjunction with or separately from the methods and apparatus described herein.

Kinetic efforts to control hydrates have included use of different materials as inhibitors. For instance, onium compounds with at least four carbon substituents are used to inhibit the plugging of conduits by gas hydrates. Additives such as polymers with lactam rings have also been employed to control clathrate hydrates in fluid systems. These kinetic inhibitors are commonly labeled Low Dosage Hydrate Inhibitors (LDHI) in the art. KHIs and even LDHIs are relatively expensive materials, and it is usually advantageous to determine ways of lowering the usage levels of these hydrate inhibitors while maintaining effective hydrate inhibition. Thus, the use of the agitation methods and apparatus discussed herein together with LDHI chemicals and other chemicals may provide a useful combination to control the size and/or production rate of gas hydrate particles.

It may also be understood within the context of this invention that the chemicals used to help promote the formation of non-agglomerating gas hydrate particles may be put into a form that delays their release or contact with the gas and water. Such delayed deployment or "timed release" of chemicals may be accomplished by many known methods in the art including encapsulation, absorption on a substrate such as a clay, forming derivatives which decompose over time to the desired hydrate control chemical, etc.

It may be understood that the energizers or vibrators 22 are also expected to transmit vibrational energy both in the radial direction (i.e., from the pipeline wall inwardly to the water/gas interface 18) and axially along the pipeline 10. It may also be only necessary to deploy or position energizers (vibrators) 22 along portions of the flowbore 12 where gas hydrate formation has been found to be or may be expected to be a problem.

Figure 5A:
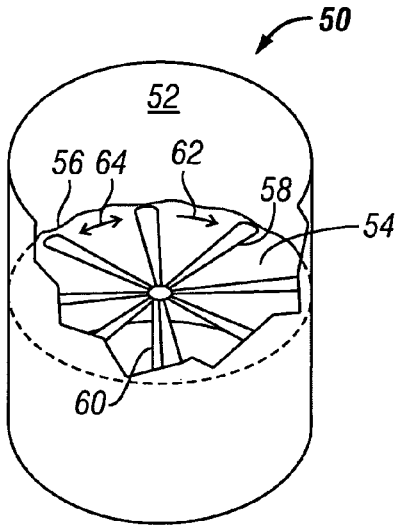
FIG. 5A is a three-quarters, cut-away view of one non-limiting embodiment of a vessel with rotary blades or vibrators constructed in accordance with the methods and apparatus herein.
Figure 5B:
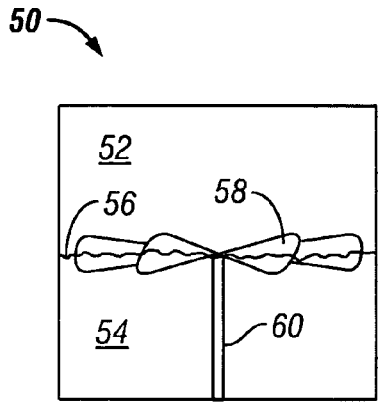
FIG. 5B is a side, cross-section of the vessel shown in FIG. 5A.

In another non-limiting embodiment, FIGS. 5A and 5B illustrate a vessel 50 having gas 52 (e.g. natural gas) and water 54 meeting at an interface 56. In this alternate version, agitation of the interface may be provided by a series of blades or propeller 58 or other suitable mechanical means. Blades 58 may rotate or spin around a central axis or axle 60 in one direction as indicated by arrow 62, although care should be taken that the rotational velocity or speed is not sufficient to cause difficulties, such as to undesirably create an emulsion between gas 52 and water 54. Alternatively, it may be found that a back and forth or oscillatory motion (as shown by arrow 64) may be more suitable for creating or causing the agitation that forms hydrate particles of the desired size and at an advantageous rate. One difficulty with the embodiment shown in FIGS. 5A and 5B may be that the rotational velocity of the blades 58 at the outer tips will be greater than that near the axis 60, and thus the agitation and the rate of formation of gas hydrate particles, and their size, may be different in different parts of the interface 56.

Figure 6A:
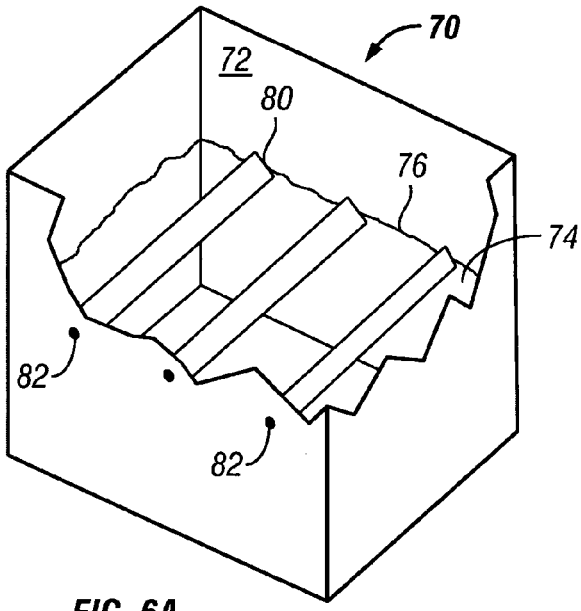
FIG. 6A a three-quarters, cut-away view of another non-limiting embodiment of a tank with linear blades or vibrators constructed in accordance with other methods and apparatus herein.
Figure 6B:
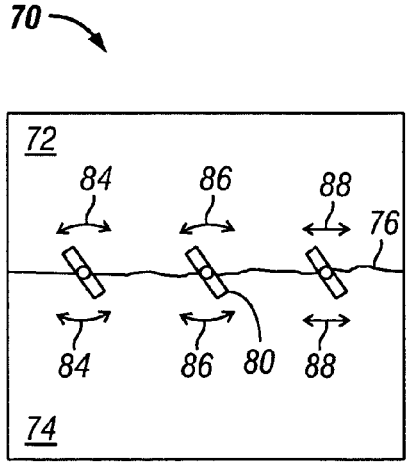
FIG. 6B is a side, cross-section of the tank shown in FIG. 6A.

Shown in FIGS. 6A and 6B is another, alternate embodiment showing a rectangular or rectilinear tank 70 having gas layer 72 (e.g. natural gas) and a water layer 74 meeting at an gas/water interface 76. In this non-limiting version, agitation to the gas/water interface 76 may be furnished by a series of paddles 80 mounted on axles or pivots 82. There are at least three types of motion that could be performed by paddles 80 as illustrated by the arrows 84, 86, and 88 in FIG. 6B. The paddles 80 could rotate in one direction about axles 82 as shown by unidirectional anows 84. Alternatively, paddles 80 could oscillate in a back and forth fashion as shown via bidirectional arrows 86. And in another embodiment, the paddles could move linearly and longitudinally back and forth as shown by bidirectional arrows 88 (left to right as shown in FIG. 6B). Paddles 80 may be at a fixed angle for the longitudinal back and forth motion or normal to the gas/water interface. Combinations of these motions could also be imagined to agitate or perturb the gas/water interface 76. The method and apparatus contemplated in the embodiment shown in FIGS. 6A and 6B could be designed to give a more uniform agitation to the gas/water interface 76, as compared to the embodiment shown in FIGS. 5A and 5B, thus possibly giving a more uniform and consistent formation of gas hydrate particles. It may be appreciated that both vessel 50 and tank 70 could be provided with one or more inlet and one or more outlet therefrom in a conventional manner. It may be further appreciated that blades 58 and/or paddles 80 may be driven by any of the vibratory or acoustic or other methods previously described.

It will also be appreciated that the pipes, conduits, flowbores, vessels, tanks and the like in which the methods and systems herein are applicable need not be horizontally oriented, such as the pipelines schematically depicted in FIGS. 1, 1A and 2. Alternatively, they may have a vertical orientation such as that seen schematically in flowbore 90 of FIG. 7, although it will be appreciated that other orientations, including, but not necessarily limited to angled, curved, etc. are just as suitable.

Figure 7:
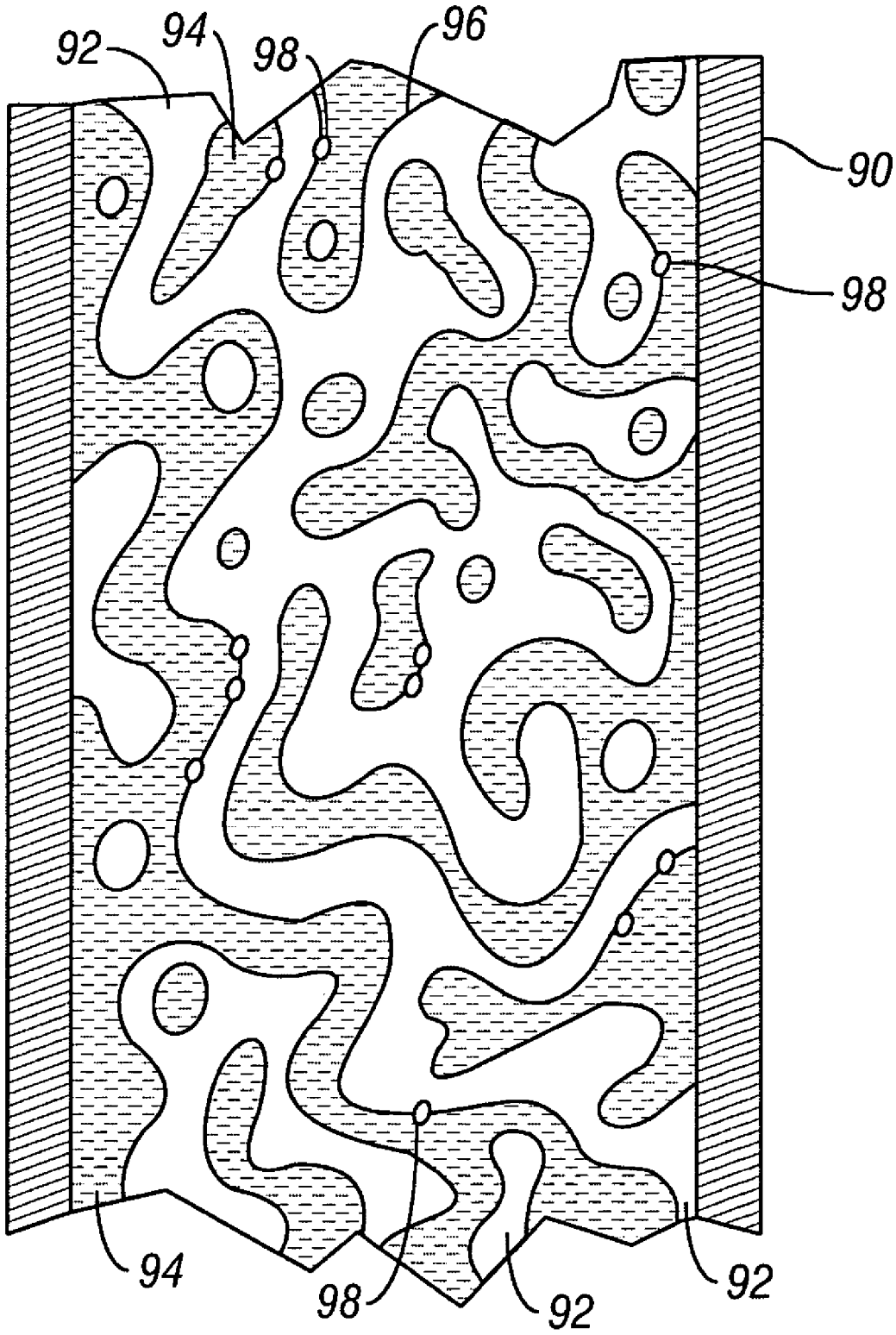
FIG. 7 is a schematic, cross-section of a vertically-oriented flowbore illustrating bi-continuous gas and water.

It will be further appreciated from FIG. 7 that there is no limiting shape or orientation or configuration to how gas and water may meet. In FIGS. 1, 1A and 2, gas 14, water 16 meet at a linearly defined interface 18, but it is expected that many situations and environments in which the methods and systems herein may be useful are not so neatly defined into discrete phases. For instance, the environment depicted in FIG. 7 shows a bi-continuous meeting of gas 92 and water 94, that is neither the water nor the gas are continuous, although they certainly may be within the methods and systems herein. There may or may not be an easily determined or clearly defined interface 96, and indeed FIG. 7 is not necessarily at any particular scale and may be molecular or larger. The bi-continuous environment of FIG. 7 does not have an internal "phase" or an external "phase" and occasionally becomes discontinuous. Gas hydrates 98 form in a controlled way where the gas 92 and the water 94 meet, where there is no particular limitation about how this meeting or contacting occurs.

Those of skill in the art will recognize that numerous modifications and changes may be made to the exemplary designs and embodiments described herein and that the invention may be limited only by the claims that follow and any equivalents thereof. For instance, various methods or techniques to agitate the gas and water may be combined and applied simultaneously or sequentially. Further, it may be found that one or another technique may be better in certain applications such as deep sea pipelines or tubing, where access for placement or maintenance is limited.

It may also be appreciated that the methods and systems herein may be used for enhanced separation or extraction of the gas molecules (e.g. $CH_4$, $CO_2$, $H_2S$, $N_2$, Ar, He, other noble gases, oxygen, etc.). These methods and systems additionally have potential for preventing, controlling, separating, extracting or sequestering other substances, such as materials considered contaminants. It is also expected and/or anticipated that the methods and systems herein may be effective to inhibit, control or prevent undesirable agglomerations or accumulations of other substances and solids such as asphaltenes, scale, paraffins and the like. In one non-limiting context, some water-based muds (WBM) have scale precipitates in them (e.g. calcium sulfate); thus it may be expected that the methods and systems herein may be adapted and useful to for controlling other solids by injecting agitation or energy at appropriate points and times.

What is claimed is:

1. A method for controlling the agglomeration of gas hydrates within a vessel or flowbore comprising:

providing gas and water in a vessel or a flowbore;

imparting relative energy to at least a portion of the gas and water to promote formation of non-agglomerating hydrate particles having an average particle size of about 0.175 inch (about 4.4 mm) in diameter or smaller.

2. The method of claim 1 where imparting relative energy comprises vibrating the portion of the gas and water by an acoustic vibrator located proximate the gas/water interface.

3. A system for controlling gas hydrates within a vessel or flowbore, the system comprising:

at least one vessel or flowbore containing gas and water; and at least one energizer to impart relative energy to at least one portion of the gas and water to promote formation of non-agglomerating hydrate particles having an average particle size of about 0.175 inch (about 4.4 mm) in diameter or smaller.

4. The system of claim 3 where the energizer is attached to the vessel or flowbore.

5. The system of claim 3 where the energizer is an acoustic vibrator.

6. A method for controlling the agglomeration of gas hydrates within a vessel or flowbore comprising:

providing gas and water in a vessel or a flowbore;

imparting relative energy at least a portion of the gas and water to promote formation of hydrate particles from the gas and water within the vessel or flowbore; and forming non-agglomerating gas hydrate particles having an average particle size of 6400 microns or less.

7. The method of claim 6 where the non-agglomerating gas hydrate particles have an average particle size of about 4400 microns or less, and further imparting relative energy to gas hydrate particles to reduce their average particle size from about 6400 microns or greater to an average particle size of about 4400 microns or less.

8. The method of claim 6 where the hydrate particles have an average particle size of about 200 microns in diameter or smaller.

9. The method of claim 6 further comprising introducing a chemical additive that further controls hydrate particle formation.

10. The method of claim 6 where the gas hydrates are natural gas hydrates.

11. The method of claim 6 further comprises introducing gas molecules to the portion of gas and water at a temperature and pressure that forms hydrate particles.

12. A system for controlling gas hydrates within a vessel or flowbore, the system comprising:

at least one vessel or flowbore containing gas and water;

at least one energizer to impart relative energy to at least one portion of the gas and water to promote formation of non-agglomerating hydrate particles, where the hydrate particles have an average particle size of about 0.25 inch (about 6.4 mm) in diameter or smaller;

at least one sensor to detect conditions favorable to hydrate formation, where the sensor is connected to a control network to activate the energizer; and an opening for introducing gas molecules to the gas and water to form hydrate particles at a temperature and a pressure for forming hydrates.

13. The system of claim 12 where the energizer is an acoustic vibrator.

14. The system of claim 12 where further comprising an opening for introducing a chemical additive to the gas/water interface.

15. A method for controlling the agglomeration of gas hydrates within a vessel or flowbore comprising:

providing gas and water in a vessel or a flowbore;

imparting relative energy to at least a portion of the gas and water to promote formation of non-agglomerating hydrate particles, where the hydrate particles have an average particle size of about 0.25 inch (about 6.4 mm) in diameter or smaller.

16. The method of claim 15 where imparting relative energy comprises energizing the portion of the gas and water at a frequency within the range of from about 1 kHz to about 20 kHz.

17. The method of claim 15 where imparting relative energy comprises vibrating the portion of the gas and water by a vibratory source that provides a vibrational amplitude in the range of from about 1 nm to about 1 cm.

18. The method of claim 15 further comprising imparting relative energy to gas hydrate particles to reduce their average particle size from about 6400 microns or greater to an average particle size of about 4400 microns or less.

19. The method of claim 15 where the hydrate particles have an average particle size of about 200 microns in diameter or smaller.

20. The method of claim 15 further comprising introducing a chemical additive that further controls hydrate particle formation.

21. The method of claim 15 where the imparting relative energy comprises mixing.

22. The method of claim 21 where the mixing comprises rotational mixing.

23. The method of claim 15 further comprising flowing the gas and water in a flowbore.

24. The method of claim 15 further comprising storing the gas and water in a vessel.

25. The method of claim 15 where the gas hydrates are natural gas hydrates.

26. The method of claim 15 further comprising introducing gas molecules to the portion of gas and water at a temperature and pressure that forms hydrate particles.

27. The method of claim 15 where imparting relative energy comprises vibrating the portion of the gas and water by an acoustic vibrator located proximate the gas/water interface.

28. A system for controlling gas hydrates within a vessel or flowbore, the system comprising:

at least one vessel or flowbore containing gas and water; and at least one energizer to impart relative energy to at least one portion of the gas and water to promote formation of non-agglomerating hydrate particles, where the hydrate particles have an average particle size of about 0.25 inch (about 6.4 mm) in diameter or smaller.

29. The system of claim 28 where the energizer comprises a rotational stirrer.

30. The system of claim 28 further comprising an opening for introducing gas molecules to the gas and water to form hydrate particles at a temperature and a pressure for forming hydrates.

31. The system of claim 28 where the energizer is attached to the vessel or flowbore.

32. The system of claim 28 where the energizer is an acoustic vibrator.

33. The system of claim 32 where the acoustic vibrator is capable of operation at a frequency in the range from about 1 kHz to about 20 kHz.

34. The system of claim 32 where the acoustic vibrator is operated at an amplitude in the range of about 1 nm to about 1 cm.

35. The system of claim 32 where the acoustic vibrator comprises a device selected from the group consisting of a horn, a piezoelectric transducer, a fluid oscillator, a voice coil actuator, a rotating eccentric mass, and combinations thereof.

36. The system of claim 32 where further comprising an opening for introducing a chemical additive to the gas/water interface.

* * * * *